US010024508B2

(12) United States Patent
Yamamoto et al.

(10) Patent No.: US 10,024,508 B2
(45) Date of Patent: Jul. 17, 2018

(54) VEHICLE LAMP

(71) Applicant: KOITO MANUFACTURING CO., LTD., Tokyo (JP)

(72) Inventors: Ippei Yamamoto, Shizuoka (JP); Masahito Naganawa, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 134 days.

(21) Appl. No.: 14/450,651

(22) Filed: Aug. 4, 2014

(65) Prior Publication Data

US 2015/0043238 A1 Feb. 12, 2015

(30) Foreign Application Priority Data

Aug. 6, 2013 (JP) ..... 2013-163318

(51) Int. Cl.

| | |
|---|---|
| ***F21V 7/00*** | (2006.01) |
| ***F21S 41/36*** | (2018.01) |
| ***F21S 41/147*** | (2018.01) |
| ***F21S 41/32*** | (2018.01) |
| ***F21S 41/663*** | (2018.01) |

(52) U.S. Cl.

CPC ..... *F21S 41/36* (2018.01); *F21S 41/147* (2018.01); *F21S 41/321* (2018.01); *F21S 41/663* (2018.01)

(58) Field of Classification Search

CPC ..... F21S 48/1159; F21S 48/1323; F21S 48/1388; F21S 48/1747; F21S 48/1352; F21S 48/1358; F21S 48/1364; F21S 48/137; F21S 48/1376

USPC ..... 362/464, 465, 507, 509, 513, 539, 543, 362/544, 516–518

See application file for complete search history.

(56) References Cited

U.S. PATENT DOCUMENTS 5,546,284 A * 8/1996 Harada ..... B60Q 1/0041 362/245
6,882,110 B2 * 4/2005 Ishida ..... B60Q 1/04 315/82

(Continued)

FOREIGN PATENT DOCUMENTS

EP 2226555 A2 9/2010
JP 2005-235520 A 9/2005

(Continued)

OTHER PUBLICATIONS

Office Action dated Mar. 3, 2016, by the State Intellectual Property Office of P.R. China in counterpart Chinese Application No. 201410384002.5.

(Continued)

*Primary Examiner* — Tsion Tumebo
(74) *Attorney, Agent, or Firm* — Sughrue Mion, PLLC

(57) ABSTRACT

A vehicle lamp 10 includes a first parabolic high-beam condensing reflector 16*b*, a second parabolic high-beam condensing reflector 17*c* and a parabolic high-beam diffusing reflector 16*a*. The first and second parabolic high-beam condensing reflectors 16*b*, 16*c* forms a high-beam condensed light distribution pattern by reflecting light emitted from light sources 18*b*, 18*c*. The high-beam diffusing reflector 16*a* forms a high-beam diffused light distribution pattern by reflecting light emitted from a light source 18*a*. A part 21 of a reflection surface of the high-beam diffusing reflector 16*a* is located in front of front end portions of the first and second parabolic condensing reflectors 16*b*, 16*c*.

7 Claims, 5 Drawing Sheets

(56) References Cited

U.S. PATENT DOCUMENTS 8,419,248 B2 * 4/2013 Toyoyama ..... B60Q 1/0433 362/538
9,227,555 B2 * 1/2016 Kalapodas ..... B60Q 1/085
2001/0028565 A1 * 10/2001 Ishida ..... B60Q 1/085 362/464
2001/0046139 A1 * 11/2001 Hashigaya ..... B60Q 1/06 362/523
2003/0156420 A1 * 8/2003 Tatsukawa ..... B60Q 1/12 362/465
2004/0120158 A1 * 6/2004 Tatsukawa ..... B60Q 1/04 362/509
2005/0094413 A1 * 5/2005 Sazuka ..... B60Q 1/0041 362/544
2006/0209556 A1 * 9/2006 Tajima ..... B60Q 1/0041 362/516
2007/0165416 A1 * 7/2007 Ishida ..... F21S 48/1159 362/487
2007/0183164 A1 * 8/2007 Naganawa ..... B60Q 1/085 362/507
2007/0236953 A1 * 10/2007 Nakazawa ..... B60Q 1/0041 362/544
2008/0062706 A1 * 3/2008 Feldmeier ..... B60Q 1/1423 362/459
2008/0225535 A1 9/2008 Mochizuki
2009/0310353 A1 12/2009 Inaba
2010/0290241 A1 * 11/2010 Tsukamoto ..... B60Q 1/0047 362/519
2013/0135886 A1 5/2013 Tanaka et al.

FOREIGN PATENT DOCUMENTS

JP 2008-222178 A 9/2008
JP 2009-301980 A 12/2009
JP 2011-81975 A 4/2011
JP 2013-114939 A 6/2013

OTHER PUBLICATIONS

Office Action dated Jul. 3, 2017 by the Japanese Patent Office in counterpart Japanese Patent Application No. 2013-163318.

* cited by examiner

VEHICLE LAMP

CROSS REFERENCE TO RELATED APPLICATION(S)

This application is based on and claims priority under 35 U.S.C. § 119 to Japanese Patent Application No 2013-163318 (filed on Aug. 6, 2013), the entire contents of which are incorporated herein by reference.

BACKGROUND

Technical Field

Exemplary embodiments of the invention relate to a vehicle lamp, and more particularly relate to a vehicle lamp in which a light emitting element such as an LED and a parabolic reflector are used.

Related Art

JP 2011-81975 A, for example, describes a vehicle lamp including a plurality of LEDs and a plurality of reflectors each of which reflects a light beam emitted from the corresponding LED.

SUMMARY

In general, to form a predetermined light distribution pattern using a plurality of reflectors, a part of the reflectors is formed so as to illuminate a light condensed region (which may be called a hot zone) in the light distribution pattern and the other reflectors are formed so as to illuminate a diffused region around the light condensed region.

However, where the reflectors for the light condensed region and those for the diffused region have certain positional relationships, a part of the light reflected by the reflector(s) for the diffused region may be shielded by the reflector(s) for the light condensed region to lower the visibility of side portions of an illumination area ahead of a vehicle (which may be referred to as an "illumination area ahead").

Exemplary embodiments of the invention have been made in view of the above circumstances, and provide a vehicle lamp which can increase the visibility of side portions of an illumination area ahead.

(1) According to one exemplary embodiment of the invention, a vehicle lamp includes a first parabolic condensing reflector and a parabolic diffusing reflector. The first parabolic condensing reflector forms a condensed light distribution pattern by reflecting light emitted from a first light source. The parabolic diffusing reflector forms a diffused light distribution pattern by reflecting light emitted from a second light source. At least a part of a reflection surface of the diffusing reflector is located in front of a front end portion of the first parabolic condensing reflector.

(2) In the vehicle lamp of (1), the diffusing reflector may be located on a vehicle inside of the first parabolic condensing reflector.

(3) In the vehicle lamp of any one of (1) to (2), an F value of the reflection surface of the diffusing reflector may be smaller than that of a reflection surface of the first parabolic condensing reflector.

(4) The vehicle lamp of any one of (1) to (3) may further include a second parabolic condensing reflector that forms a low-beam condensed light distribution pattern. The condensed light distribution pattern formed by the first parabolic condensing reflector may be a high-beam condensed light distribution pattern. The first parabolic condensing reflector and the second parabolic condensing reflector may be integrated together.

(5) In the vehicle lamp of any one of (1) to (4), the first light source and the second light source may be mounted on a common board that extends in a horizontal direction.

One exemplary embodiment of the invention can provide a vehicle lamp which can increase the visibility of side portions of an illumination area ahead.

DETAILED DESCRIPTION

Vehicle lamps according to exemplary embodiments of the invention will be hereinafter described in detail with reference to the accompanying drawings. In this specification, when direction-indicative terms such as "top," "bottom," "front," "rear," "left," "right," "inside," and "outside" are used, these terms mean directions in a state where the vehicle lamp is mounted in a predetermined posture in a vehicle.

Figure 1:
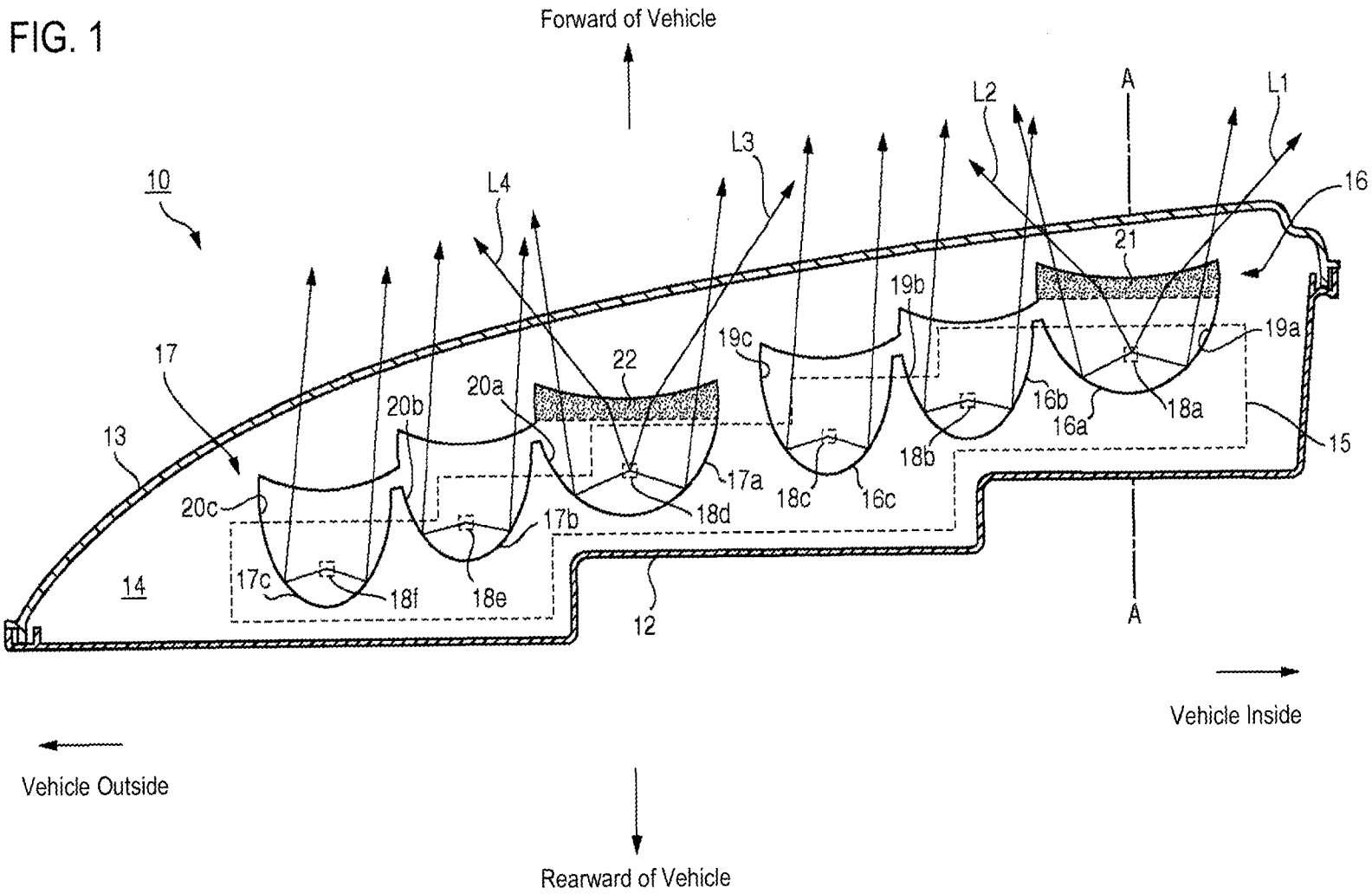
FIG. 1 is a schematic horizontal section view of a vehicle lamp according to a first embodiment of the invention.
Figure 2:
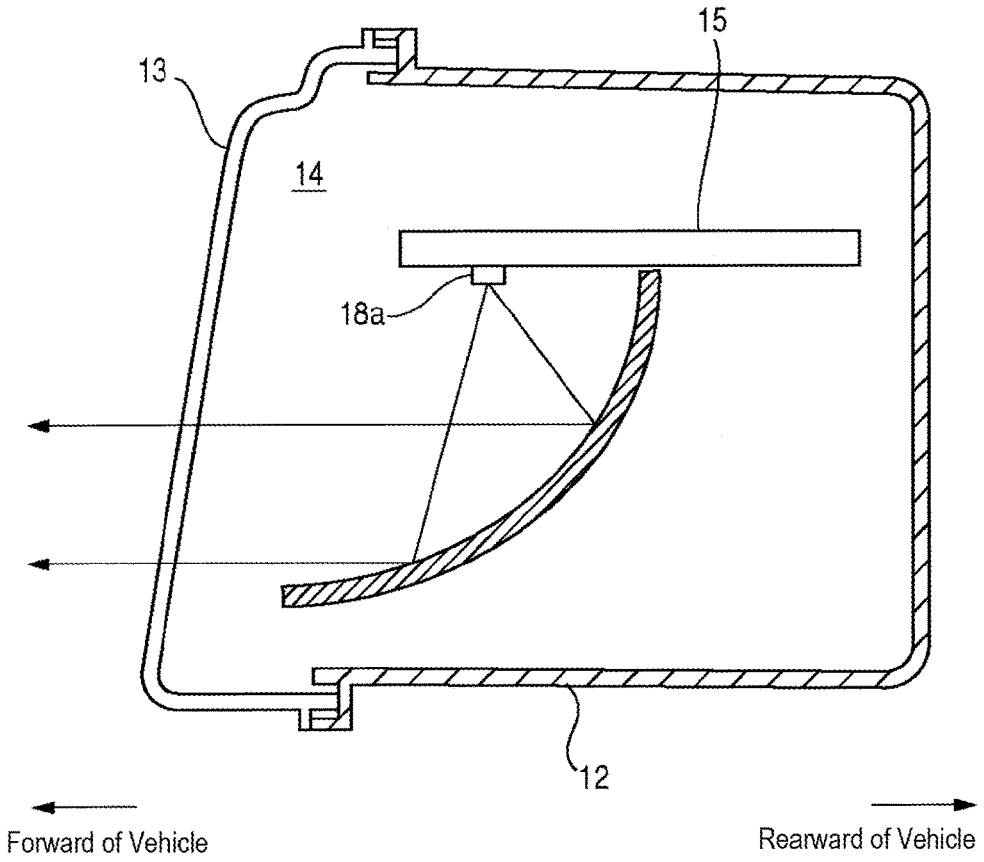
FIG. 2 is a section view of the vehicle lamp taken along a line A-A in FIG. 1.

FIG. 1 is a schematic horizontal section view of a vehicle lamp 10 according to a first embodiment of the invention. FIG. 2 is a section view of the vehicle lamp 10 taken along a line A-A in FIG. 1. The vehicle lamp 10 shown in FIG. 1 is one of two (left and right) headlamps provided in a front portion of a vehicle. Since these headlamps are substantially the same in structure, the structure of the left-hand vehicle lamp 10 will be described below representatively.

As shown in FIGS. 1 and 2, the vehicle lamp 10 includes a lamp body 12 and a transparent outer cover 13 which covers a front opening of the lamp body 12. A lamp chamber 14 is formed by the lamp body 12 and the outer cover 13. As shown in FIG. 1, the outer cover 13 has a shape that conforms to a slant nose shape of the vehicle and is thus inclined rearward from the vehicle inside toward the vehicle outside. Conforming to the shape of the thus-inclined shape of the outer cover 13, the lamp body 12 has a step-like shape so as to come closer to the rear side of the vehicle from the vehicle inside toward the vehicle outside. Therefore, the lamp chamber 14, which is formed by the lamp body 12 and the outer cover 13, is a space that is inclined rearward from the vehicle inside toward the vehicle outside.

A board 15, a high-beam reflector unit 16, and a low-beam reflector unit 17 are housed in the lamp chamber 14. The board 15, the high-beam reflector unit 16, and the low-beam reflector unit 17 are fixed to the lamp body 12 by respective support members (not shown).

The board 15 is disposed in an upper portion of the lamp chamber 14 and extends horizontally from the vehicle inside toward the vehicle outside. As shown in FIG. 1, conforming to the slanted shape of the outer cover 13, the board 15 has a step-like shape so as to come closer to the rear side of the vehicle from the vehicle inside to the vehicle outside.

Six LEDs (first to sixth LEDs 18*a* to 18*f*) are mounted on the board 15 with their light emitting surfaces down. The first to sixth LEDs 18*a* to 18*f* are supplied with currents from the board 15 to emit light.

The first to third LEDs 18*a* to 18*c* are LEDs for high-beam illumination and are disposed on the vehicle inside of a center of the board 15. Among these three LEDs 18*a* to 18*c*, the first LED 18*a* is located vehicle-innermost (rightmost in FIG. 1). The second LED 18*b* is located on the vehicle outside of the first LED 18*a* (in FIG. 1, on the left side of the first LED 18*a*). The third LED 18*c* is located on the vehicle outside of the second LED 18*b*.

The fourth to six LEDs 18*d* to 18*f* are LEDs for low-beam illumination and are disposed on the vehicle outside of the center of the board 15. Among these three LEDs 18*d* to 18*f*, the fourth LED 18*d* is located vehicle-innermost. The fifth LED 18*e* is located on the vehicle outside of the fourth LED 18*d*. The sixth LED 18*f* is located on the vehicle outside of the fifth LED 18*e*.

The high-beam reflector unit 16 and the low-beam reflector unit 17 are disposed side by side below the board 15 in the lamp chamber 14. The high-beam reflector unit 16 is located on the vehicle inside of the low-beam reflector unit 17.

The high-beam reflector unit 16 is a reflector group for high-beam illumination and includes three parabolic reflectors, that is, a high-beam diffusing reflector 16*a*, a first high-beam condensing reflector 16*b*, and a second high-beam condensing reflector 16*c*. The three reflectors 16*a* to 16*c* are integrated together. Among the three reflectors 16*a* to 16*c*, the high-beam diffusing reflector 16*a* is located vehicle-innermost. The first high-beam condensing reflector 16*b* is located on the vehicle outside of the high-beam diffusing reflector 16*a*. The second high-beam condensing reflector 16*c* is located on the vehicle outside of the first high-beam condensing reflector 16*b*.

The high-beam diffusing reflector 16*a*, the first high-beam condensing reflector 16*b*, and the second high-beam condensing reflector 16*c* have respective reflection surfaces 19*a* to 19*c* each of which is formed with a paraboloid of revolution as a reference. The first LED 18*a* is disposed at a focal position of the reflection surface 19*a* of the high-beam diffusing reflector 16*a*. The second LED 18*b* is disposed at a focal position of the reflection surface 19*b* of the first high-beam condensing reflector 16*b*. The third LED 18*c* is disposed at a focal position of the reflection surface 19*c* of the second high-beam condensing reflector 16*c*.

The low-beam reflector unit 17 is a reflector group for low-beam illumination and includes three parabolic reflectors, that is, a low-beam diffusing reflector 17*a*, a first low-beam condensing reflector 17*b*, and a second low-beam condensing reflector 17*c*. The three reflectors 17*a* to 17*c* are integrated together. Among the three reflectors 17*a*-17*c*, the low-beam diffusing reflector 17*a* is located vehicle-innermost. The first low-beam condensing reflector 17*b* is located on the vehicle outside of the low-beam diffusing reflector 17*a*. The second low-beam condensing reflector 17*c* is located on the vehicle outside of the first low-beam condensing reflector 17*b*.

The low-beam diffusing reflector 17*a*, the first low-beam condensing reflector 17*b*, and the second low-beam condensing reflector 17*c* have respective reflection surfaces 20*a* to 20*c* each of which is formed with a paraboloid of revolution as a reference. The fourth LED 18*d* is disposed at a focal position of the reflection surface 20*a* of the low-beam diffusing reflector 17*a*. The fifth LED 18*e* is disposed at a focal position of the reflection surface 20*b* of the first low-beam condensing reflector 17*b*. The sixth LED 18*f* is disposed at a focal position of the reflection surface 20*c* of the second low-beam condensing reflector 17*c*.

Figure 3:
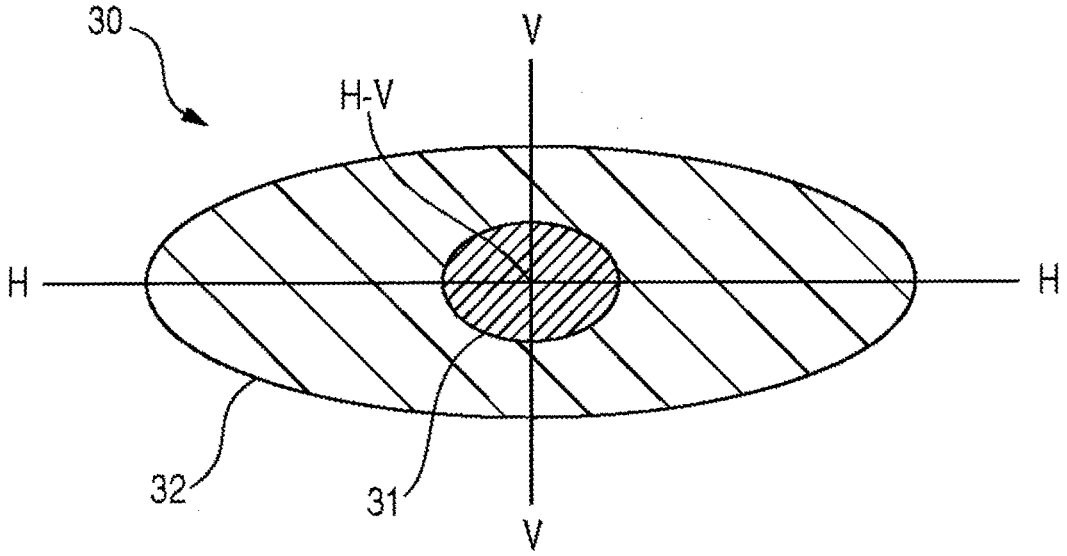
FIG. 3 shows a high-beam light distribution pattern which is formed by a high-beam lamp unit.

In the first embodiment, the high-beam reflector unit 16 and the first to third LEDs 18*a* to 18*c* constitute a high-beam lamp unit for high-beam illumination. FIG. 3 shows a high-beam light distribution pattern 30 which is formed by the high-beam lamp unit. The high-beam light distribution pattern 30 shown in FIG. 3 is a light distribution pattern that is formed on a virtual vertical screen disposed at a position that is distant forward from the vehicle lamp 10 by 25 m. A vertical line V-V and a horizontal line H-H which pass though an H-V point which is a vanishing point in a lamp forward direction are shown in FIG. 3.

A high-beam condensed light distribution pattern 31 is formed around the H-V point by (i) light that is emitted from the second LED 18*b* and reflected by the reflection surface 19*b* of the first high-beam condensing reflector 16*b* and (ii) light that is emitted from the third LED 18*c* and reflected by the reflection surface 19*c* of the second high-beam condensing reflector 16*c*. The high-beam condensed light distribution pattern 31 is a high luminous intensity region which is called a "hot zone." Also, a high-beam diffused light distribution pattern 32 is formed by light that is emitted from the first LED 18*a* and reflected by the reflection surface 19*a* of the high-beam diffusing reflector 16*a*, so as to contain the high-beam condensed light distribution pattern 31. The high-beam diffused light distribution pattern 32 is wider than the high-beam condensed light distribution pattern 31 in both of the direction of the horizontal line H-H and the direction of the vertical line V-V The high-beam condensed light distribution pattern 31 may be a region of about ±10° to 15° in the direction of the horizontal line H-H and about ±3° to 5° in the direction of the vertical line V-V. The high-beam diffused light distribution pattern 32 may be a region of about ±25° to 35° in the direction of the horizontal line H-H and about ±8° to 10° in the direction of the vertical line V-V The high-beam condensed light distribution pattern 31 and the high-beam diffused light distribution pattern 32 are superimposed on each other to form the high-beam light distribution pattern 30.

Figure 4:
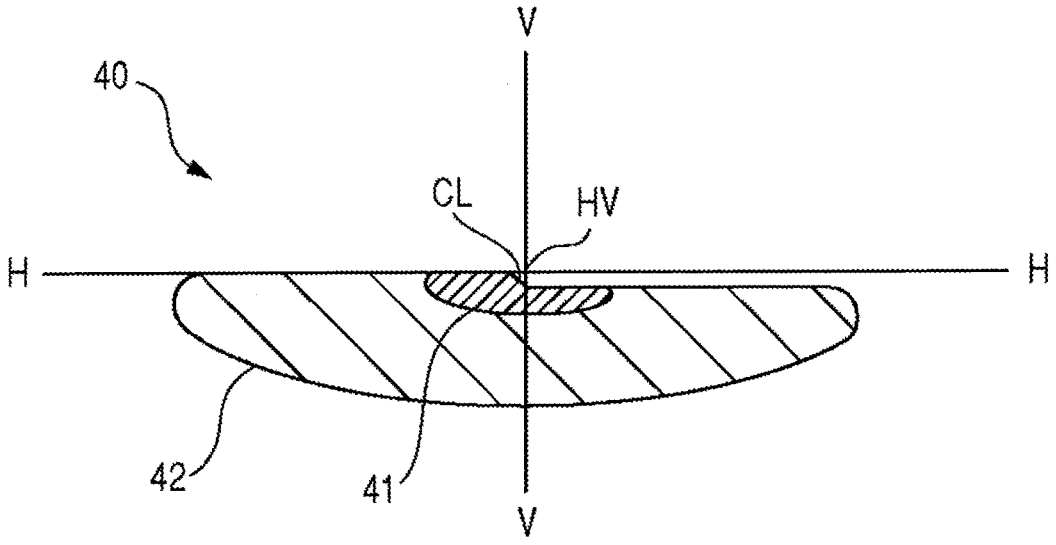
FIG. 4 shows a low-beam light distribution pattern which is formed by a low-beam lamp unit.

In the first exemplary embodiment, the low-beam reflector unit 17 and the fourth to sixth LEDs 18*d* to 18*f* constitute a low-beam lamp unit for low-beam illumination. FIG. 4 shows a low-beam light distribution pattern 40 which is formed by the low-beam lamp unit. The low-beam light distribution pattern 40 shown in FIG. 4 is a light distribution pattern which has a cutoff line having a predetermined shape.

A low-beam condensed light distribution pattern 41 is formed around the H-V point by (i) light that is emitted from the fifth LED 18*e* and reflected by the reflection surface 20*b* of the first low-beam condensing reflector 17*b* and (ii) light that is emitted from the six LED 18*f* and reflected by the reflection surface 20*c* of the second low-beam condensing reflector 17*c*. The low-beam condensed light distribution pattern 41 is a high luminous intensity region called a "hot zone" and has the cutoff line having the predetermined shape. Also, a low-beam diffused light distribution pattern 42 is formed by light that is emitted from the fourth LED 18*d* and reflected by the reflection surface 20*a* of the low-beam diffusing reflector 17*a*, so as to contain the low-beam condensed light distribution pattern 41. The low-beam diffused light distribution pattern 42 is wider than the low-beam condensed light distribution pattern 41 in both of the direction of the horizontal line H-H and the direction of the vertical line V-V. The low-beam condensed light distribution pattern 41 may be a region of about ±10° to 15° in the direction of the horizontal line H-H and about 0° to −5° in the direction of the vertical line V-V. The low-beam diffused light distribution pattern 42 may be a region of about ±25° to 45° in the direction of the horizontal line H-H and about 0° to −10° in the direction of the vertical line V-V. The low-beam condensed light distribution pattern 41 and the low-beam diffused light distribution pattern 42 are superimposed on each other to form the low-beam light distribution pattern 40.

As described above, the high-beam diffusing reflector 16*a* is located on the vehicle inside of the first high-beam condensing reflector 16*b* and the second high-beam condensing reflector 16*c* (in FIG. 1, on the right side of the first high-beam condensing reflector 16*b* and the second high-beam condensing reflector 16*c*). In the first embodiment, the outer cover 13 is inclined rearward from the vehicle inside toward the vehicle outside. Therefore, a front portion 21 (hatched in FIG. 1) of the reflection surface 19*a* of the high-beam diffusing reflector 16*a* is located in front of front end portions of the first and second high-beam condensing reflectors 16*b*, 16*c*.

FIG. 1 shows light beams L1 and L2 reflected by the front portion 21 of the reflection surface 19*a* of the high-beam diffusing reflector 16*a*. In the first embodiment, the front portion 21 of the reflection surface 19*a* of the high-beam diffusing reflector 16*a* is located in front of the front end portions of the high-beam condensing reflectors 16*b* and 16*c*. Therefore, the light beams L1 and L2 reflected by the front portion 21 are not shielded by the high-beam condensing reflector 16*b* or 16*c*. That is, since the front portion 21 of the reflection surface 19*a* of the high-beam diffusing reflector 16*a* is located in front of the front end portions of the high-beam condensing reflectors 16*b* and 16*c*, diffusion light paths of the light beams L1 and L2 are secured and the visibility of the side portions of the illumination area ahead of the vehicle can thereby enhanced.

In the first embodiment, the low-beam reflector unit 17 is configured similarly to the high-beam reflector unit 16. That is, the low-beam diffusing reflector 17*a* of the low-beam reflector unit 17 is located on the vehicle inside of the first low-beam condensing reflector 17*b* and the second low-beam condensing reflector 17*c* (in FIG. 1, on the right side of the first low-beam condensing reflector 17*b* and the second low-beam condensing reflector 17*c*). Therefore, a front portion 22 (hatched in FIG. 1) of the reflection surface 20*a* of the low-beam diffusing reflector 17*a* is located in front of the front end portions of the first and second low-beam condensing reflectors 17*b*, 17*c*.

FIG. 1 shows light beams L3 and L4 reflected by the front portion 22 of the reflection surface 20*a* of the low-beam diffusing reflector 17*a*. In the first embodiment, the front portion 22 of the reflection surface 20*a* of the low-beam diffusing reflector 17*a* is located in front of the front end portions of the low-beam condensing reflectors 17*b* and 17*c*. Therefore, the light beams L3 and L4 reflected by the front portion 22 are not shielded by the low-beam condensing reflector 17*b* or 17*c*. That is, since the front portion 22 of the reflection surface 20*a* of the low-beam diffusing reflector 17*a* is located in front of the front end portions of the low-beam condensing reflectors 17*b* and 17*c*, diffusion light paths of the light beams L3 and L4 are secured, which also contributes to the enhancement of the visibility of the side portions of the illumination area ahead of the vehicle.

In the first embodiment, the front portion of the reflection surface of the diffusing reflector is located in front of the front end portions of the condensing reflectors. However, the visibility of the side portions of the illumination area ahead can be enhanced so long as at least a part of the reflection surface of the diffusing reflector is located in front of the front end portions of the condensing reflectors.

Figure 5:
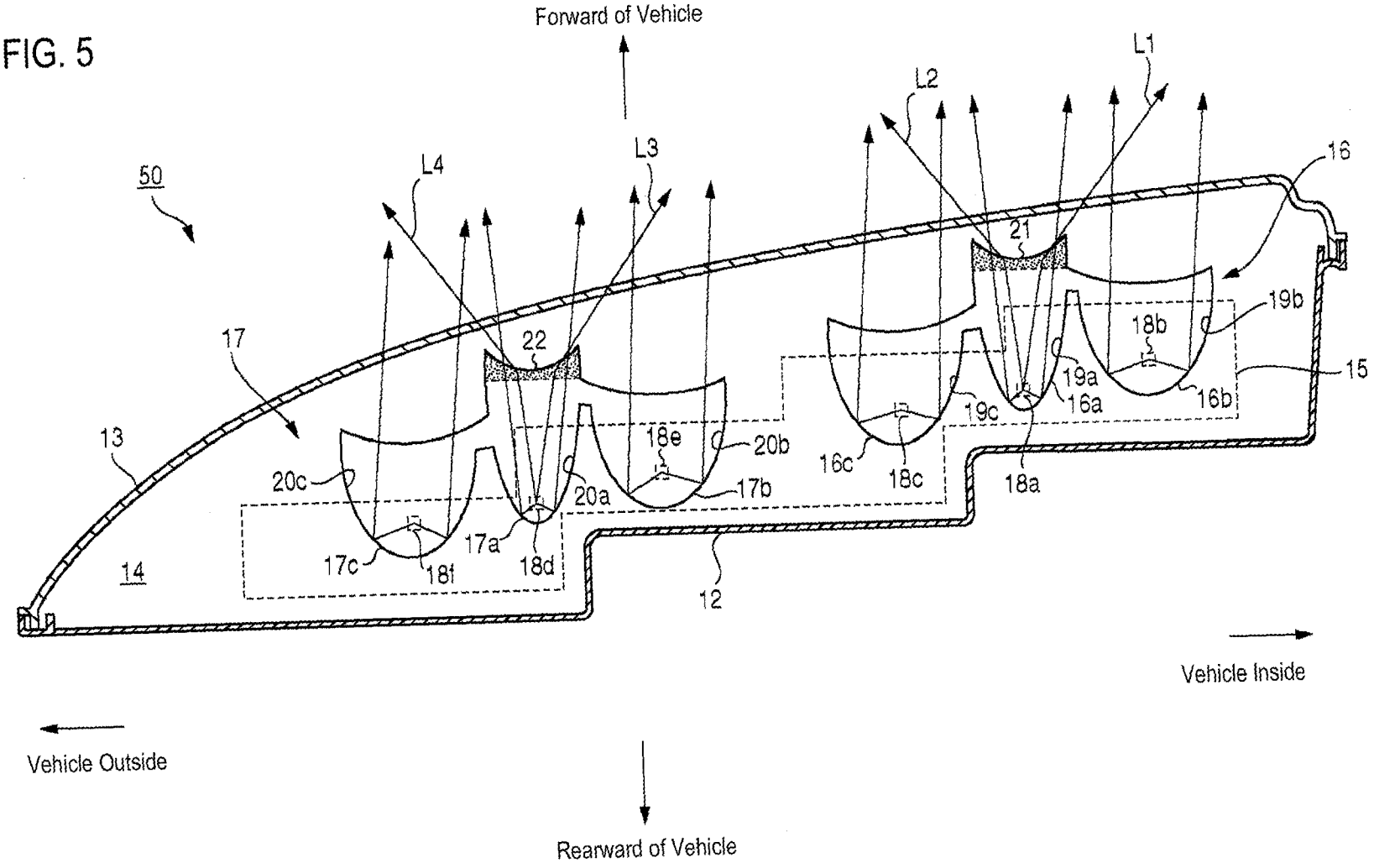
FIG. 5 is a schematic horizontal section view of a vehicle lamp according to a second embodiment of the invention.

FIG. 5 is a schematic horizontal section view of a vehicle lamp 50 according to a second embodiment of the invention. Elements of the vehicle lamp 50 shown in FIG. 5 which are the same as or correspond to those in the vehicle lamp 10 shown in FIG. 1 are given the same reference symbols and may not be described redundantly.

The vehicle lamp 50 according to the second embodiment is different from the vehicle lamp 10 shown in FIG. 1 in the structures of the high-beam reflector unit 16 and the low-beam reflector unit 17.

The high-beam reflector unit 16 is disposed on the vehicle inside of the low-beam reflector unit 17 (in FIG. 5, on the right side of the low-beam reflector unit 17) and include a high-beam diffusing reflector 16*a*, a first high-beam condensing reflector 16*b*, and a second high-beam condensing reflector 16*c*. The three reflectors 16*a* to 16*c* are integrated together.

In the second embodiment, the first high-beam condensing reflector 16*b* is located vehicle-innermost. The high-beam diffusing reflector 16*a* is located on the vehicle outside of the first high-beam condensing reflector 16*b*. The second high-beam condensing reflector 16*c* is located on the vehicle outside of the high-beam diffusing reflector 16*a*. That is, the high-beam diffusing reflector 16*a* is located between the first high-beam condensing reflector 16*b* and the second high-beam condensing reflector 16*c*.

Where the high-beam diffusing reflector 16*a* is located on the vehicle outside of the first high-beam condensing reflector 16*b* as described above, the high-beam diffusing reflector 16*a* as a whole is located in rear of the first high-beam condensing reflector 16*b* due to the arrangement space (i.e., the outer cover 13 is inclined rearward from the vehicle inside toward the vehicle outside). In this case, if an ordinary design were to be employed, light beams that travel toward side portions of an illumination area ahead of the vehicle from the reflection surface 19*a* of the high-beam diffusing reflector 16*a* might be shielded by the first high-beam condensing reflector 16*b*. In view of this, in the second embodiment, the F value (focal length) of the reflection surface 19*a* of the high-beam diffusing reflector 16*a* is set to be smaller than that of the first reflection surface 19*b* of the first high-beam condensing reflector 16*b* so that a front portion 21 (hatched in FIG. 5) of the reflection surface 19*a* of the high-beam diffusing reflector 16*a* is located in front of the front end portion of the first high-beam condensing reflector 16*b*.

FIG. 5 shows light beams L1 and L2 reflected by the front portion 21 of the reflection surface 19*a* of the high-beam diffusing reflector 16*a*. In the second embodiment, the front portion 21 of the reflection surface 19*a* of the high-beam diffusing reflector 16*a* is located in front of the front end portions of the high-beam condensing reflectors 16*b* and 16*c*. Therefore, the light beams L1 and L2 reflected by the front portion 21 are not shielded by the high-beam condensing reflector 16*b* or 16*c*. Accordingly, diffusion light paths of the light beams L1 and L2 are secured, and the visibility of the side portions of the illumination area ahead of the vehicle can thereby enhanced.

The low-beam reflector unit 17 is configured similarly to the high-beam reflector unit 16. That is, the low-beam reflector unit 17 is located on the vehicle outside of the high-beam reflector unit 16 and includes three parabolic reflectors, that is, a low-beam diffusing reflector 17*a*, a first low-beam condensing reflector 17*b*, and a second low-beam condensing reflector 17*c*. The three reflectors 17*a* to 17*c* are integrated together.

In the second embodiment, the first low-beam condensing reflector 17*b* is located vehicle-innermost. The low-beam diffusing reflector 17*a* is located on the vehicle outside of the first low-beam condensing reflector 17*b*. The second low-beam condensing reflector 17*c* is located on the vehicle outside of the low-beam diffusing reflector 17*a*. That is, the low-beam diffusing reflector 17*a* is located between the first low-beam condensing reflector 17*b* and the second low-beam condensing reflector 17*c*.

In the second embodiment, the F value (focal length) of the reflection surface 20*a* of the low-beam diffusing reflector 17*a* is set to be smaller than that of the reflection surface 20*b* of the first low-beam condensing reflector 17*b* so that a front portion 22 (hatched in FIG. 5) of the reflection surface 20*a* of the low-beam diffusing reflector 17*a* is located in front of the front end portion of the first low-beam condensing reflector 17*b*.

FIG. 5 shows light beams L3 and L4 reflected by the front portion 22 of the reflection surface 20*a* of the low-beam diffusing reflector 17*a*. In the second embodiment, the front portion 22 of the reflection surface 20*a* of the low-beam diffusing reflector 17*a* is located in front of the front end portions of the low-beam condensing reflectors 17*b* and 17*c*. Therefore, the light beams L3 and L4 reflected by the front portion 22 are not shielded by the low-beam condensing reflector 17*b* or 17*c*. Accordingly, diffusion light paths of the light beams L3 and L4 are secured, which also contributes to the enhancement of the visibility of the side portions of the illumination area ahead of the vehicle.

Figure 6:
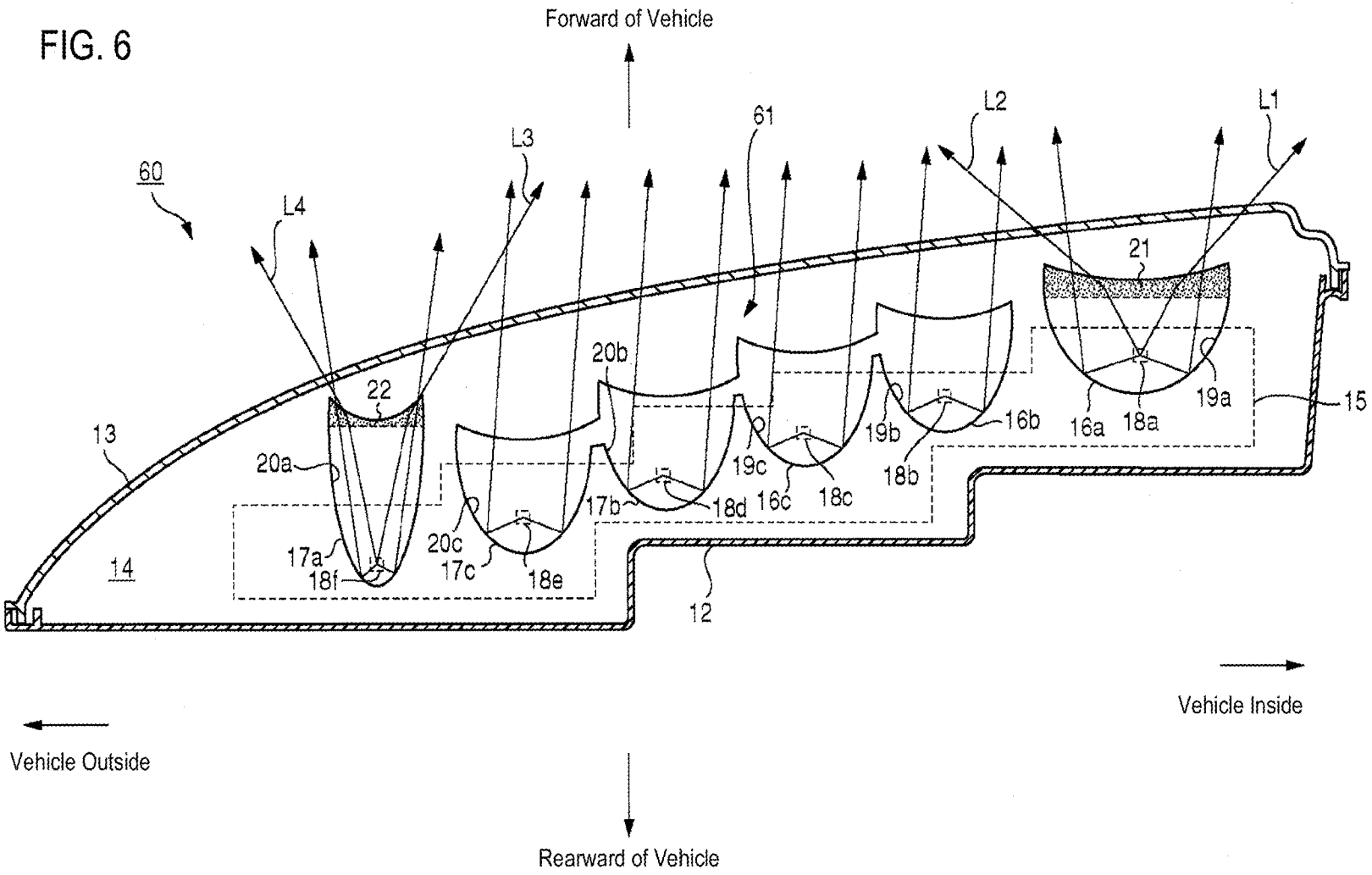
FIG. 6 is a schematic horizontal section view of a vehicle lamp according to a third embodiment of the invention.

FIG. 6 is a schematic horizontal section view of a vehicle lamp 60 according to a third embodiment of the invention. Elements of the vehicle lamp 60 shown in FIG. 6 which are the same as or correspond to those in the vehicle lamp 10 shown in FIG. 1 are given the same reference symbols and may not be described redundantly.

In the vehicle lamp 60 according to the third embodiment, a high-beam diffusing reflector 16*a*, a condensing reflector unit 61, and a low-beam diffusing reflector 17*a* are provided in the lamp chamber 14.

The condensing reflector unit 61 is configured so that first and second high-beam condensing reflectors 16*b*, 16*c* for a high-beam condensed light distribution pattern and first and second low-beam condensing reflectors 17*b*, 17*c* for a low-beam condensed light distribution pattern are integrated together. Among the four reflectors 16*b*, 16*c*, 17*b*, and 17*d*, the first high-beam condensing reflector 16*b* is located vehicle-innermost. The second high-beam condensing reflector 16*c* is located on the vehicle outside of the first high-beam condensing reflector 16*b*. The first low-beam condensing reflector 17*b* is located on the vehicle outside of the second high-beam condensing reflector 16*c*. The second low-beam condensing reflector 17*c* is located on the vehicle outside of the first low-beam condensing reflector 17*b*.

The high-beam diffusing reflector 16*a* which is closest to the front-rear center line of the vehicle is the same as the one shown in FIG. 1. The high-beam diffusing reflector 16*a* is located on the vehicle inside the condensing reflector unit 61. Also in this embodiment, since the outer cover 13 is inclined rearward from the vehicle inside towards the vehicle outside, a front portion 21 (hatched in FIG. 6) of the reflection surface 19*a* of the high-beam diffusing reflector 16*a* is located in front of the front end portions of the condensing reflector unit 61.

FIG. 6 shows light beams L1 and L2 reflected by the front portion 21 of the reflection surface 19*a* of the high-beam diffusing reflector 16*a*. In this embodiment, since the front portion 21 of the reflection surface 19*a* of the high-beam diffusing reflector 16*a* is located in front of the front end portions of the condensing reflector unit 61, the light beams L1 and L2 reflected by the front portion 21 are not shielded by the high-beam condensing reflector 16*b* or 16*c*. Therefore, diffusion light paths of the light beams L1 and L2 are secured and the visibility of side portions of an illumination area ahead can thereby increased.

The low-beam diffusing reflector 17*a* which is most distant from the front-rear center line of the vehicle is the same as the one shown in FIG. 5. In this embodiment, the low-beam diffusing reflector 17*a* is located on the vehicle outside of the condensing reflector unit 61. However, in this embodiment, the F value of the reflection surface 20*a* of the low-beam diffusing reflector 17*a* is set smaller than that of the reflection surface 20*c* of the adjacent second low-beam condensing reflector 17*c*, so that a front portion 22 (hatched in FIG. 6) of the reflection surface 20*a* of the low-beam diffusing reflector 16*a* is located in front of the front end portion of the second low-beam condensing reflector 17*c*.

FIG. 6 shows light beams L3 and L4 reflected by the front portion 22 of the reflection surface 20*a* of the low-beam diffusing reflector 17*a*. In the third embodiment, the front portion 22 of the reflection surface 20*a* of the low-beam diffusing reflector 17*a* is located in front of the front end portion of the adjacent low-beam condensing reflector 17*c*. Therefore, the light beams L3 and L4 reflected by the front portion 22 are not shielded by the adjacent low-beam condensing reflector 17*c*. Accordingly, diffusion light paths of the light beams L3 and L4 are secured, which also contributes to the enhancement of the visibility of the side portions of the illumination area ahead of the vehicle.

Furthermore, in the third embodiment, the first high-beam condensing reflector 16*b*, the second high-beam condensing reflector 16*c*, the first low-beam condensing reflector 17*b*, and the second low-beam condensing reflector 17*c* are integrated together as mentioned above.

In vehicle lamps in which plural parabolic reflectors are used and in which a high-beam condensing reflector(s) and a low-beam condensing reflector(s) are configured as separate elements as in the first embodiment shown in FIG. 1, if the high-beam condensing reflector(s) and the low-beam condensing reflector(s) are mounted at positions which are deviated from the design positions, the intended positional relationship between a high-beam condensed light distribution pattern and a low-beam condensed light distribution pattern would be lost. For example, if adjustments are made so as to form a low-beam condensed light distribution pattern that is located at the ideal position (i.e., located around the H-V point), a high-beam condensed light distribution pattern may deviate from around the H-V point to lower the long-distance visibility at the time of high-beam illumination. In the third embodiment, the high-beam LEDs 18*b* and 18*c* and the low-beam LEDs 18*d* and 18*e* are mounted on the single, common board 15. Therefore, it may be difficult to control the positions of a high-beam condensed light distribution pattern and a low-beam condensed light distribution pattern to be located in the ideal positions by adjusting the postures of the high-beam condensing reflectors 16*b* and 16*c* and the low-beam condensing reflectors 17*b* and 17*c*.

In view of the above, in the third embodiment, the high-beam condensing reflectors 16*b* and 16*c* and the low-beam condensing reflectors 17*b* and 17*c* are integrated together. With this structure, the positional deviations between the high-beam condensing reflectors 16*b*, 16*c* and the low-beam condensing reflectors 17*b*, 17*c* can be suppressed. Thereby, it can be prevented that the positions of a high-beam condensed light distribution pattern and a low-beam condensed light distribution pattern deviate from the ideal positions. As a result, the vehicle lamp 60 is given high long-distance visibility.

The invention has been described with reference to the exemplary embodiments. It should be noted the exemplary embodiments are just examples. One skilled in the art would appreciate that the respective elements and a combination(s) of the elements can be modified in various ways and that the scope of the invention should encompass such modifications.

For example, in the above described exemplary embodiments, LEDs are employed as light sources. However, the light sources are not limited to LEDs but may be semiconductor lasers, light bulbs, or the like.

What is claimed is:

1. A vehicle lamp comprising:

a first parabolic condensing reflector that forms a condensed light distribution pattern by reflecting light emitted from a first light source; and a parabolic diffusing reflector that forms a diffused light distribution pattern by reflecting light emitted from a second light source, wherein at least a part of a reflection surface of the diffusing reflector is located in front of a front end portion of the first parabolic condensing reflector, the condensing reflector and the diffusing reflector are integrated with each other and arranged in a lateral row extending from a vehicle inside to a vehicle outside or vice versa, and the first light source and the second light source are mounted on a common board that extends in a horizontal direction and are supplied with currents from said common board, wherein the first light source and the second light source are mounted on said common board with their light emitting surfaces down, and the condensing reflector and the diffusing reflector are disposed below said common board.

2. The vehicle lamp according to claim 1, wherein the diffusing reflector is located on the vehicle inside of the first parabolic condensing reflector.

3. The vehicle lamp according to claim 1, wherein a focal length (F) of the reflection surface of the diffusing reflector is smaller than that of a reflection surface of the first parabolic condensing reflector.

4. The vehicle lamp according to claim 1, further comprising:

a second parabolic condensing reflector that forms a low-beam condensed light distribution pattern, wherein the condensed light distribution pattern formed by the first parabolic condensing reflector is a high-beam condensed light distribution pattern, and the first parabolic condensing reflector and the second parabolic condensing reflector are integrated together.

5. The vehicle lamp according to claim 1, further comprising:

a second parabolic condensing reflector that forms a condensed light distribution pattern by reflecting light emitted from a third light source, wherein the diffusing reflector is integrated with and disposed between the first and second condensing reflectors in the row, with the at least part of the reflection surface of the diffusing reflector also being located in front of a front end portion of the second parabolic condensing reflector.

6. The vehicle lamp according to claim 1, wherein the high-beam light distribution pattern is formed by the superimposition of a high-beam condensed light distribution pattern and a high-beam diffused light distribution pattern.

7. The vehicle lamp according to claim 1, wherein the low-beam light distribution pattern is formed by the superimposition of a low-beam condensed light distribution pattern and a low-beam diffused light distribution pattern.

* * * * *